US007985379B2

(12) United States Patent
Chiu et al.

(10) Patent No.: US 7,985,379 B2
(45) Date of Patent: Jul. 26, 2011

(54) REACTOR DESIGN TO REDUCE PARTICLE DEPOSITION DURING PROCESS ABATEMENT

(75) Inventors: Ho-Man Rodney Chiu, San Jose, CA (US); Daniel O. Clark, Pleasanton, CA (US); Shaun W. Crawford, San Ramon, CA (US); Jay J. Jung, Sunnyvale, CA (US); Leonard B. Todd, Napa, CA (US); Robbert Vermeulen, Pleasant Hill, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1015 days.

(21) Appl. No.: 11/838,435

(22) Filed: Aug. 14, 2007

(65) Prior Publication Data

US 2007/0274876 A1 Nov. 29, 2007

Related U.S. Application Data

(63) Continuation of application No. 10/987,921, filed on Nov. 12, 2004, now Pat. No. 7,736,599.

(51) Int. Cl.
*B01D 50/00* (2006.01)

(52) U.S. Cl. ..... 422/168

(58) Field of Classification Search ..... 422/168, 422/169, 171, 172, 173; 55/240, 248
See application file for complete search history.

(56) References Cited

U.S. PATENT DOCUMENTS

| | | | |
|---|---|---|---|
| 2,819,151 | A | 1/1958 | Flemmert |
| 3,185,846 | A | 5/1965 | Gilbert et al. |
| 3,203,759 | A | 8/1965 | Flemmert |
| 3,276,506 | A | 10/1966 | Micko |
| 3,603,711 | A | 9/1971 | Downs |
| 3,698,696 | A | 10/1972 | Rauskolb |
| 3,813,852 | A | 6/1974 | Steineke |
| 3,845,191 | A | 10/1974 | Bruce et al. |
| 3,898,040 | A | 8/1975 | Tabak |
| 3,949,057 | A | 4/1976 | Gilbert, Jr. |
| 3,969,482 | A | 7/1976 | Teller |
| 3,969,485 | A | 7/1976 | Flemmert |
| 3,983,021 | A | 9/1976 | Henis |
| 4,011,298 | A | 3/1977 | Fukui et al. |
| 4,059,386 | A | 11/1977 | Eising |
| 4,083,607 | A | 4/1978 | Mott |
| 4,154,141 | A | 5/1979 | Sayles |

(Continued)

FOREIGN PATENT DOCUMENTS

DE 215706 11/1984

(Continued)

OTHER PUBLICATIONS

Office Action of U.S. Appl. No. 11/555,087 mailed Mar. 25, 2008.

(Continued)

*Primary Examiner* — Tom Duong
(74) *Attorney, Agent, or Firm* — Dugan & Dugan, P.C.

(57) ABSTRACT

The present invention relates to systems and methods for controlled combustion and decomposition of gaseous pollutants while reducing deposition of unwanted reaction products from within the treatment systems. The systems include a novel thermal reaction chamber design having stacked reticulated ceramic rings through which fluid, e.g., gases, may be directed to form a boundary layer along the interior wall of the thermal reaction chamber, thereby reducing particulate matter buildup thereon. The systems further include the introduction of fluids from the center pilot jet to alter the aerodynamics of the interior of the thermal reaction chamber.

27 Claims, 10 Drawing Sheets

U.S. PATENT DOCUMENTS

| | | | |
|---|---|---|---|
| 4,172,708 | A | 10/1979 | Wu et al. |
| 4,206,189 | A | 6/1980 | Kosintsev et al. |
| 4,236,464 | A | 12/1980 | Anderson et al. |
| 4,238,460 | A | 12/1980 | Aiken et al. |
| 4,243,372 | A | 1/1981 | Cade |
| 4,296,079 | A | 10/1981 | Hauser |
| 4,374,649 | A | 2/1983 | Rao |
| 4,392,821 | A | 7/1983 | Füssl et al. |
| 4,479,443 | A | 10/1984 | Faldt et al. |
| 4,479,809 | A | 10/1984 | Johnson et al. |
| 4,483,672 | A | 11/1984 | Wallace et al. |
| 4,519,999 | A | 5/1985 | Coleman |
| 4,541,995 | A | 9/1985 | Kim et al. |
| 4,555,389 | A | 11/1985 | Soneta et al. |
| 4,584,001 | A | 4/1986 | Dechene |
| 4,644,877 | A | 2/1987 | Barton et al. |
| 4,661,056 | A | 4/1987 | Vickery et al. |
| 4,719,088 | A | 1/1988 | Itoh et al. |
| 4,753,915 | A | 6/1988 | Vogt et al. |
| 4,788,036 | A | 11/1988 | Eiselstein et al. |
| 4,801,437 | A | 1/1989 | Konagaya et al. |
| 4,834,020 | A | 5/1989 | Bartholomew |
| 4,886,444 | A | 12/1989 | Hirase et al. |
| 4,908,191 | A | 3/1990 | Boldish et al. |
| 4,935,212 | A | 6/1990 | Jacob |
| 4,954,320 | A | 9/1990 | Birmingham et al. |
| 4,966,611 | A | 10/1990 | Schumacher et al. |
| 4,975,098 | A | 12/1990 | Lee et al. |
| 4,981,722 | A | 1/1991 | Moller et al. |
| 4,986,838 | A | 1/1991 | Johnsgard |
| 4,993,358 | A | 2/1991 | Mahawili |
| 5,000,221 | A | 3/1991 | Palmer |
| 5,009,869 | A | 4/1991 | Weinberg et al. |
| 5,011,520 | A | 4/1991 | Carr et al. |
| 5,045,288 | A | 9/1991 | Raupp et al. |
| 5,045,511 | A | 9/1991 | Bosomworth et al. |
| 5,077,525 | A | 12/1991 | West et al. |
| 5,113,789 | A | 5/1992 | Kamian |
| 5,114,683 | A | 5/1992 | Hirase |
| 5,118,286 | A | 6/1992 | Sarin |
| 5,122,391 | A | 6/1992 | Mayer |
| 5,123,836 | A | 6/1992 | Yoneda et al. |
| 5,136,975 | A | 8/1992 | Bartholomew et al. |
| 5,137,701 | A | 8/1992 | Mundt |
| 5,147,421 | A | 9/1992 | Yung |
| 5,151,116 | A | 9/1992 | Scholz et al. |
| 5,154,237 | A | 10/1992 | Cooper |
| 5,160,707 | A | 11/1992 | Murray et al. |
| 5,176,897 | A | 1/1993 | Lester |
| 5,183,646 | A | 2/1993 | Anderson et al. |
| 5,199,856 | A | 4/1993 | Epstein et al. |
| 5,206,003 | A | 4/1993 | Imoto et al. |
| 5,207,836 | A | 5/1993 | Chang |
| 5,211,729 | A | 5/1993 | Sherman |
| 5,213,767 | A | 5/1993 | Smith et al. |
| 5,220,940 | A | 6/1993 | Palmer |
| 5,238,656 | A | 8/1993 | Tajima et al. |
| 5,251,654 | A | 10/1993 | Palmer |
| 5,252,007 | A | 10/1993 | Klinzing et al. |
| 5,255,709 | A | 10/1993 | Palmer |
| 5,255,710 | A | 10/1993 | Palmer |
| 5,271,908 | A | 12/1993 | Shiban et al. |
| 5,280,664 | A | 1/1994 | Lin |
| 5,281,302 | A | 1/1994 | Gabric et al. |
| 5,292,704 | A | 3/1994 | Lester |
| 5,304,398 | A | 4/1994 | Krusell et al. |
| 5,320,124 | A | 6/1994 | Palmer |
| 5,361,800 | A | 11/1994 | Ewing |
| 5,364,604 | A | 11/1994 | Spink et al. |
| 5,393,394 | A | 2/1995 | Ikeda et al. |
| 5,407,647 | A | 4/1995 | Tarancon |
| 5,417,934 | A | 5/1995 | Smith et al. |
| 5,425,886 | A | 6/1995 | Smith |
| 5,439,568 | A | 8/1995 | Uchiyama |
| 5,450,873 | A | 9/1995 | Palmer et al. |
| 5,453,125 | A | 9/1995 | Krogh |
| 5,453,494 | A | 9/1995 | Kirlin et al. |
| 5,456,280 | A | 10/1995 | Palmer |
| 5,494,004 | A | 2/1996 | Hunter, Jr. |
| 5,495,893 | A | 3/1996 | Roberts et al. |
| 5,510,066 | A | 4/1996 | Fink et al. |
| 5,510,093 | A | 4/1996 | Bartz et al. |
| 5,527,631 | A | 6/1996 | Singh et al. |
| 5,533,890 | A | 7/1996 | Holst et al. |
| 5,572,866 | A | 11/1996 | Loving |
| 5,575,636 | A | 11/1996 | Kobayashi et al. |
| 5,584,959 | A | 12/1996 | Kimura et al. |
| 5,589,148 | A | 12/1996 | Otsuka et al. |
| 5,597,540 | A | 1/1997 | Akita et al. |
| 5,599,508 | A | 2/1997 | Martinelli et al. |
| 5,601,790 | A | 2/1997 | Stilger et al. |
| 5,603,905 | A | 2/1997 | Bartz et al. |
| 5,643,545 | A | 7/1997 | Chen et al. |
| 5,649,985 | A | 7/1997 | Imamura |
| 5,650,128 | A | 7/1997 | Holst et al. |
| 5,663,476 | A | 9/1997 | Cripe et al. |
| 5,665,317 | A | 9/1997 | Laslo |
| 5,693,293 | A | 12/1997 | Reichardt et al. |
| 5,702,999 | A | 12/1997 | Mazanec et al. |
| H1701 | H | 1/1998 | DePinto et al. |
| 5,716,428 | A | 2/1998 | Imamura |
| 5,720,444 | A | 2/1998 | Wheeler et al. |
| 5,720,931 | A | 2/1998 | Rossin et al. |
| 5,749,720 | A | 5/1998 | Fukuda et al. |
| 5,756,052 | A | 5/1998 | Suzumura |
| 5,759,237 | A | 6/1998 | Li et al. |
| 5,759,498 | A | 6/1998 | Sheu et al. |
| 5,762,893 | A | 6/1998 | Scholz et al. |
| 5,779,863 | A | 7/1998 | Ha et al. |
| 5,779,998 | A | 7/1998 | Tom |
| 5,785,741 | A | 7/1998 | Li et al. |
| 5,788,778 | A | 8/1998 | Shang et al. |
| 5,790,934 | A | 8/1998 | Say et al. |
| 5,800,792 | A | 9/1998 | Ibaraki et al. |
| 5,817,284 | A | 10/1998 | Nakano et al. |
| 5,833,888 | A | 11/1998 | Arya et al. |
| 5,840,897 | A | 11/1998 | Kirlin et al. |
| 5,843,239 | A | 12/1998 | Shrotriya |
| 5,843,288 | A | 12/1998 | Yamamoto |
| 5,855,648 | A | 1/1999 | Prasad et al. |
| 5,855,822 | A | 1/1999 | Chen |
| 5,858,065 | A | 1/1999 | Li et al. |
| 5,865,879 | A | 2/1999 | Lee |
| 5,877,391 | A | 3/1999 | Kanno et al. |
| 5,891,404 | A | 4/1999 | Ibaraki et al. |
| 5,900,217 | A | 5/1999 | Hartung et al. |
| 5,914,091 | A | 6/1999 | Holst et al. |
| 5,919,285 | A | 7/1999 | Li et al. |
| 5,935,283 | A | 8/1999 | Sweeney et al. |
| 5,935,540 | A | 8/1999 | Otsuka et al. |
| 5,938,422 | A | 8/1999 | Smith et al. |
| 5,955,037 | A | 9/1999 | Holst et al. |
| 5,957,678 | A | 9/1999 | Endoh et al. |
| 5,965,786 | A | 10/1999 | Rostaing et al. |
| 5,972,078 | A | 10/1999 | Collins et al. |
| 5,989,412 | A | 11/1999 | Okagami et al. |
| 5,992,409 | A | 11/1999 | Heimlich et al. |
| 6,007,742 | A | 12/1999 | Czernichowski et al. |
| 6,009,827 | A | 1/2000 | Robles et al. |
| 6,010,576 | A | 1/2000 | Lin |
| 6,013,584 | A | 1/2000 | M'saad et al. |
| 6,030,591 | A | 2/2000 | Tom et al. |
| 6,059,858 | A | 5/2000 | Lin et al. |
| 6,072,227 | A | 6/2000 | Yau et al. |
| 6,095,084 | A | 8/2000 | Shamouilian et al. |
| 6,110,529 | A | 8/2000 | Gardiner et al. |
| 6,153,150 | A | 11/2000 | Moore et al. |
| 6,153,159 | A | 11/2000 | Engeler et al. |
| 6,185,839 | B1 | 2/2001 | Kholodenko et al. |
| 6,187,072 | B1 | 2/2001 | Cheung et al. |
| 6,187,080 | B1 | 2/2001 | Ping-Chung et al. |
| 6,190,507 | B1 | 2/2001 | Whealton et al. |
| 6,217,640 | B1 | 4/2001 | Lu et al. |
| 6,234,787 | B1 | 5/2001 | Endoh et al. |
| 6,261,524 | B1 | 7/2001 | Herman et al. |
| 6,322,756 | B1 | 11/2001 | Arno et al. |
| 6,338,312 | B2 | 1/2002 | Hayes et al. |

| | | | |
|---|---|---|---|
| 6,345,768 | B1 | 2/2002 | Inagaki et al. |
| 6,361,584 | B1 | 3/2002 | Stevens et al. |
| 6,423,284 | B1 | 7/2002 | Arno et al. |
| 6,464,944 | B1 | 10/2002 | Moore et al. |
| 6,468,490 | B1 | 10/2002 | Shamouilian et al. |
| 6,491,884 | B1 | 12/2002 | Faller et al. |
| 6,494,711 | B1 | 12/2002 | Takemura et al. |
| 6,511,641 | B2 | 1/2003 | Herman et al. |
| 6,527,828 | B2 | 3/2003 | Flippo et al. |
| 6,544,482 | B1 | 4/2003 | Inori |
| 6,551,381 | B2 | 4/2003 | Flippo et al. |
| 6,655,137 | B1 | 12/2003 | Sardari |
| 6,712,603 | B2 | 3/2004 | Pettit |
| 6,736,635 | B1 | 5/2004 | Takemura et al. |
| 6,805,728 | B2 | 10/2004 | Sweeney et al. |
| 6,813,943 | B2 | 11/2004 | Smith et al. |
| 6,824,748 | B2 | 11/2004 | Kaushal et al. |
| 6,843,830 | B2 | 1/2005 | Sherer |
| 6,875,007 | B2 | 4/2005 | Pettit |
| 6,946,107 | B2 | 9/2005 | Carlborg et al. |
| 6,969,250 | B1 | 11/2005 | Kawamura et al. |
| 7,047,893 | B2 | 5/2006 | Loving |
| 7,160,521 | B2 | 1/2007 | Porshnev et al. |
| 7,316,721 | B1 | 1/2008 | Redden et al. |
| 2001/0001652 | A1 | 5/2001 | Kanno et al. |
| 2001/0032543 | A1 | 10/2001 | Seeley et al. |
| 2001/0055555 | A1 | 12/2001 | Herman et al. |
| 2002/0066535 | A1 | 6/2002 | Brown et al. |
| 2002/0110500 | A1 | 8/2002 | Moore et al. |
| 2002/0159924 | A1 | 10/2002 | Arno et al. |
| 2002/0182131 | A1 | 12/2002 | Kaushal et al. |
| 2004/0028590 | A1 | 2/2004 | Tsuji et al. |
| 2004/0065013 | A1 | 4/2004 | DeVries |
| 2004/0161718 | A1 | 8/2004 | Pettit |
| 2004/0191146 | A1 | 9/2004 | Shinohara et al. |
| 2004/0213721 | A1 | 10/2004 | Arno et al. |
| 2004/0216610 | A1 | 11/2004 | Tom et al. |
| 2004/0237781 | A1 | 12/2004 | Terada et al. |
| 2005/0135984 | A1 | 6/2005 | Ferron |
| 2006/0024226 | A1 | 2/2006 | Park et al. |
| 2006/0104879 | A1 | 5/2006 | Chiu et al. |
| 2007/0169889 | A1 | 7/2007 | Clark |
| 2007/0172398 | A1 | 7/2007 | Clark |
| 2007/0172399 | A1 | 7/2007 | Clark |
| 2007/0190469 | A1 | 8/2007 | Clark |
| 2009/0010816 | A1 | 1/2009 | Ferron et al. |

FOREIGN PATENT DOCUMENTS

| | | | |
|---|---|---|---|
| DE | 4311061 | A1 | 10/1994 |
| DE | 4319118 | A1 | 12/1994 |
| DE | 4321762 | A1 | 1/1995 |
| DE | 19526737 | | 1/1997 |
| EP | 0 306 540 | A1 | 3/1989 |
| EP | 0 360 941 | A2 | 4/1990 |
| EP | 0 412 456 | A2 | 2/1991 |
| EP | 0 597 393 | A1 | 5/1994 |
| EP | 0 642 809 | A1 | 3/1995 |
| EP | 0 694 735 | A1 | 1/1996 |
| EP | 0 802 370 | A2 | 10/1997 |
| EP | 0 809 071 | A1 | 11/1997 |
| EP | 0 861 683 | A2 | 9/1998 |
| EP | 0 885 648 | | 12/1998 |
| EP | 0 916 388 | A2 | 5/1999 |
| EP | 0916388 | | 5/1999 |
| EP | 0916388 | A2 | 5/1999 |
| EP | 0 919 773 | A1 | 6/1999 |
| EP | 933120 | | 8/1999 |
| EP | 1 129 775 | | 9/2001 |
| EP | 1 143 197 | A1 | 10/2001 |
| EP | 1 240 937 | A1 | 9/2002 |
| EP | 1 431 657 | A1 | 6/2004 |
| FR | 2 062 565 | | 6/1971 |
| GB | 2 028 998 | A | 3/1980 |
| JP | 51129868 | | 11/1976 |
| JP | 57-091725 | | 6/1982 |
| JP | 57-117333 | | 7/1982 |
| JP | 5845718 | | 3/1983 |
| JP | 59082927 | | 5/1984 |
| JP | 61-021717 | | 1/1986 |
| JP | 61-200851 | | 9/1986 |
| JP | 62-273039 | | 11/1987 |
| JP | 63-062528 | | 3/1988 |
| JP | 02-068414 | | 3/1990 |
| JP | 02-102719 | | 4/1990 |
| JP | 02 225905 | A | 9/1990 |
| JP | 03-047516 | | 2/1991 |
| JP | 39768 | | 2/1991 |
| JP | 91009768 | | 2/1991 |
| JP | 03-65218 | | 3/1991 |
| JP | 03-262523 | | 11/1991 |
| JP | 04-050422 | | 2/1992 |
| JP | 04-209524 | | 10/1992 |
| JP | 05-192534 | | 8/1993 |
| JP | 05-296979 | | 11/1993 |
| JP | 06-063357 | | 3/1994 |
| JP | 06-137537 | | 5/1994 |
| JP | 06 313532 | A | 11/1994 |
| JP | 07-10335 | | 1/1995 |
| JP | 07-323211 | | 12/1995 |
| JP | 08-309146 | | 11/1996 |
| JP | 08-333453 | | 12/1996 |
| JP | 09 133333 | A | 5/1997 |
| JP | 10192653 | | 7/1998 |
| JP | 11-070322 | | 3/1999 |
| JP | 11276860 | | 10/1999 |
| JP | 11-319485 | A1 | 11/1999 |
| JP | 11-335164 | | 12/1999 |
| JP | 2000-108245 | | 4/2000 |
| JP | 2001-082723 | | 3/2001 |
| JP | 2001082723 | A | 3/2001 |
| KR | 1999-7143 | | 1/1999 |
| WO | WO 96/16720 | A1 | 6/1996 |
| WO | WO 9749479 | A1 | 12/1997 |
| WO | WO 98/29181 | | 7/1998 |
| WO | WO 99/02921 | A1 | 1/1999 |
| WO | WO 99/61132 | | 2/1999 |
| WO | WO 00/09258 | A1 | 2/2000 |
| WO | WO 00/67879 | A1 | 11/2000 |
| WO | WO 01/78873 | A1 | 10/2001 |
| WO | WO 2004/031073 | A2 | 4/2004 |
| WO | WO 2005/062772 | | 7/2005 |
| WO | WO 2006/053231 | | 5/2006 |
| WO | WO 2007/053626 | | 12/2007 |

OTHER PUBLICATIONS

Sep. 22, 2008 Response to Office Action of U.S. Appl. No. 11/555,087 mailed Mar. 25, 2008.

Office Action of U.S. Appl. No. 11/555,087 mailed Dec. 24, 2008.

May 26, 2009 Response to Office Action of U.S. Appl. No. 11/555,087 mailed Dec. 24, 2008.

Final Office Action of U.S. Appl. No. 11/555,087 mailed Aug. 11, 2009.

Preliminary Amendment of U.S. Appl. No. 10/987,921 mailed May 10, 2007.

Office Action of U.S. Appl. No. 10/987,921 mailed Apr. 4, 2008.

Sep. 4, 2008 Response to Office Action of U.S. Appl. No. 10/987,921 mailed Apr. 4, 2008.

Oct. 5, 2008 Supplemental Response to Office Action of U.S. Appl. No. 10/987,921 mailed Apr. 4, 2008.

Final Office Action of U.S. Appl. No. 10/987,921 mailed Jan. 6, 2009.

Apr. 2, 2009 Response to Final Office Action of U.S. Appl. No. 10/987,921 mailed Jan. 6, 2009.

Notice of Allowance of U.S. Appl. No. 10/987,921 mailed Jul. 13, 2009.

International Preliminary Report on Patentability of International Application No. PCT/US2005/040960 mailed May 24, 2007.

"Integrated Thermal/Wet: CVD Effluent Treatment System", 2002, pp. 1-2, ATMI, Inc., San Jose, CA.

Viswanath et al., "Preparation and study of YSTZ-AL2O3 nanocomposites", Journal of Materials Science, 1999, pp. 2879-2886, vol. 34, Kluwer Academic Publishers.

Viskanta et al., "Measurement and correlation of volumetric heat transfer coefficieients of cellular ceramics", Experimental Thermal and Fluid Science, 1998, pp. 285-293, vol. 17, Elsevier Science Inc.

Vedula et al, "Test Methodology for the thermal shock characterization of ceramics", Journal of Materials Science, 1998, pp. 5427-5432, vol. 33, Kluwer Academic Publishers.
(PCT/US05/040960) ISR & WO dated Aug. 14, 2006.
Notice of Allowance of U.S. Appl. No. 10/987,921 mailed Feb. 16, 2010.
(App. No. 04814510.6) Search Report dtd Jan. 5, 2009.
International Search Report and Written Opinion of PCT/US06/42501 mailed on Oct. 31, 2007.
ISR & WrO dtd Nov. 16, 2006 [PCT/US2004/042334].
Office Action of Chinese Patent Application No. 200480038033.X dated Jul. 25, 2008.
Office Action of Malaysia Patent Application No. PI 20045188 dated Mar. 19, 2008.
Office Action of Taiwan Patent Application No. 094139700 mailed Jun. 8, 2009.
Office Action of Chinese Patent Application No. 200580039393.6 dated Feb. 27, 2009.
Terminal Disclaimer of U.S. Appl. No. 10/987,921 filed in U.S. Appl. No. 11/555,087 on Sep. 22, 2008.
Terminal Disclaimer of U.S. Appl. No. 11/838,435 filed in U.S. Appl. No. 11/555,087 on Sep. 22, 2008.
Examiner Interview Summary of U.S. Appl. No. 11/555,087 mailed Nov. 9, 2009.
Examiner Interview Summary of U.S. Appl. No. 11/555,087 mailed May 26, 2010.
Interview Summary of U.S. Appl. No. 10/987,921 filed Jun. 26, 2009.
Terminal Disclaimer of U.S. Appl. No. 11/555,056 filed in U.S. Appl. No. 10/987,921 on Jun. 26, 2009.
Terminal Disclaimer of U.S. Appl. No. 11/555,000 filed in U.S. Appl. No. 10/987,921 on Jun. 26, 2009.
Terminal Disclaimer of U.S. Appl. No. 11/838,435 filed in U.S. Appl. No. 10/987,921 on Jun. 26, 2009.
Terminal Disclaimer of U.S. Appl. No. 11/555,087 filed in U.S. Appl. No. 10/987,921 on Jun. 26, 2009.
Notice of Allowance of U.S. Appl. No. 10/987,921 mailed Nov. 6, 2009.
Nov. 10, 2009 Response to Final Office Action of U.S. Appl. No. 11/555,087 mailed Aug. 11, 2009.
Abreu, et al. Causes of anomalous solid formation in the exhaust system of low-pressure chemical vapor deposition plasma enhanced chemical vapor deposition semiconductor processes, J. Vac. Sci. Technol B 12(4) Jul./Aug. 1994, pp. 2763/2767.
Cady, George Hamilton, "Reaction of Fluorine with Water and with Hydroxides", Feb. 1935, J. J. Am. Chem. Soc., vol. 57, pp. 246-249.
Catalytic Decomposition System, Hitachi America, Ltd. Semiconductor Equipment Group-SCDS Gas Abatement Systems, <http://www.hitachi.com/semiequipment/productsscds.html>, pp. 1-2, printed on Apr. 21, 1999.
Environmental—Complete system solutions for air pollution control (Brochure—<http://www.olpidurr.com/e/images/environmental2001.pdf>), Dürr Environmental, Inc. <http://www.olpidurr.com/e/eco/ecopage.htm>, pp. 1-12.
Fenwal Test Detonation Arresting System at NMERI Site, May 1992 test of Fenwal Detonation Arresting System at New Mexico Engineering Research Institute.
Hardwick, Steven J., et al., "Waste Minimization in Semiconductor Processing", 1994, Mater. Res. Soc. Symp. Proc., vol. 344, pp. 273-278.
Hayakawa, Saburo, "Silane Gas Scrubber", Koatsu Gasu, 24(7), p. 371-9, (1987).
Holmes, John T., et al., "Fluidized Bed Disposal of Fluorine", Oct. 1967, I&EC Process Design and Development, vol. 6, No. 4, pp. 408-413.
Kanken Techno detoxifier KT 1000 Venus, Crystec Technology Trading GmbH, <http://www.crystec.com/ktcvenue.htm>, pp. 1-4, printed on Jul. 27, 1999.
Landau, Ralph, et al., "Industrial handling of Flourine", Mar. 1947, Industrial and Engineering Chemistry, vol. 39, No. 3, pp. 281-286.
Langan, John., et al., "Strategies for greenhouse gas reduction", Jul. 1996, Solid State Technology, pp. 115-119.
M. Brinkmann et al., "Unsteady State Treatment of Very Lean Waste Gases in a Network of Catalytic Burners", 1999, Elsevier Science B. V.—Catalysis Today 47, pp. 263-277.
Slabey, Vernon A., et al., "Rate of Reaction of Gaseous Fluorine with Water Vapor at 35° C", (1958), National Advisory Committee for Aeronautics, Technical Note 4374, pp. 1-16.
Smiley, et al. "Continuous Disposal of Fluorine", Industrial and Engineering Chemistry, 1954, vol. 46, No. 2, pp. 244-247.
Streng, A. G., "The Fluorine-Steam Flame and Its Characteristics", Jun. 1962, Combustion Flame, vol. 6, pp. 89-91.
Turnbull, S. G., et al., "Analysis and Disposal of Fluorine", Industrial and Engineering Chemistry, Mar. 1947, vol. 39, No. 3, pp. 286-288.
Office Action of U.S. Appl. No. 11/555,087 mailed Nov. 20, 2009.

REACTOR DESIGN TO REDUCE PARTICLE DEPOSITION DURING PROCESS ABATEMENT

The present application is a continuation of and claims priority to U.S. patent application Ser. No. 10/987,921, filed Nov. 12, 2004, now U.S. Pat. No. 7,736,599, which is hereby incorporated by reference herein in its entirety.

BACKGROUND OF THE INVENTION

1. Field of the Invention

The present invention relates to improved systems and methods for the abatement of industrial effluent fluids, such as effluent gases produced in semiconductor manufacturing processes, while reducing the deposition of reaction products in the treatment systems.

2. Description of the Related Art

The gaseous effluents from the manufacturing of semiconductor materials, devices, products and memory articles involve a wide variety of chemical compounds used and produced in the process facility. These compounds include inorganic and organic compounds, breakdown products of photoresist and other reagents, and a wide variety of other gases that must be removed from the waste gas before being vented from the process facility into the atmosphere.

Semiconductor manufacturing processes utilize a variety of chemicals, many of which have extremely low human tolerance levels. Such materials include gaseous hydrides of antimony, arsenic, boron, germanium, nitrogen, phosphorous, silicon, selenium, silane, silane mixtures with phosphine, argon, hydrogen, organosilanes, halosilanes, halogens, organometallics and other organic compounds.

Halogens, e.g., fluorine ($F_2$) and other fluorinated compounds, are particularly problematic among the various components requiring abatement. The electronics industry uses perfluorinated compounds (PFCs) in wafer processing tools to remove residue from deposition steps and to etch thin films. PFCs are recognized to be strong contributors to global warming and the electronics industry is working to reduce the emissions of these gases. The most commonly used PFCs include, but are not limited to, $CF_4$, $C_2F_6$, $SF_6$, $C_3F_8$, $C_4H_8$, $C_4H_8O$ and $NF_3$. In practice, these PFCs are dissociated in a plasma to generate highly reactive fluoride ions and fluorine radicals, which do the actual cleaning and/or etching. The effluent from these processing operations include mostly fluorine, silicon tetrafluoride ($SiF_4$), hydrogen fluoride (HF), carbonyl fluoride ($COF_2$), $CF_4$ and $C_2F_6$.

A significant problem of the semiconductor industry has been the removal of these materials from the effluent gas streams. While virtually all U.S. semiconductor manufacturing facilities utilize scrubbers or similar means for treatment of their effluent gases, the technology employed in these facilities is not capable of removing all toxic or otherwise unacceptable impurities.

One solution to this problem is to incinerate the process gas to oxidize the toxic materials, converting them to less toxic forms. Such systems are almost always over-designed in terms of treatment capacity, and typically do not have the ability to safely deal with a large number of mixed chemistry streams without posing complex reactive chemical risks. Further, conventional incinerators typically achieve less than complete combustion thereby allowing the release of pollutants, such as carbon monoxide (CO) and hydrocarbons (HC), to the atmosphere. Furthermore, one of the problems of great concern in effluent treatment is the formation of acid mist, acid vapors, acid gases and NOx (NO, $NO_2$) prior to discharge. A further limitation of conventional incinerators is their inability to mix sufficient combustible fuel with a non-flammable process stream in order to render the resultant mixture flammable and completely combustible.

Oxygen or oxygen-enriched air may be added directly into the combustion chamber for mixing with the waste gas to increase combustion temperatures, however, oxides, particularly silicon oxides may be formed and these oxides tend to deposit on the walls of the combustion chamber. The mass of silicon oxides formed can be relatively large and the gradual deposition within the combustion chamber can induce poor combustion or cause clogging of the combustion chamber, thereby necessitating increased maintenance of the equipment. Depending on the circumstances, the cleaning operation of the abatement apparatus may need to be performed once or twice a week.

It is well known in the arts that the destruction of a halogen gas requires high temperature conditions. To handle the high temperatures, some prior art combustion chambers have included a circumferentially continuous combustion chamber made of ceramic materials to oxidize the effluent within the chamber (see, e.g., U.S. Pat. No. 6,494,711 in the name of Takemura et al., issued Dec. 17, 2002). However, under the extreme temperatures needed to abate halogen gases, these circumferentially continuous ceramic combustion chambers crack due to thermal shock and thus, the thermal insulating function of the combustion chamber fails. An alternative includes the controlled decomposition/oxidation (CDO) systems of the prior art, wherein the effluent gases undergo combustion in the metal inlet tubes, however, the metal inlet tubes of the CDO's are physically and corrosively compromised at the high temperatures, e.g., ≈1260° C.-1600° C., needed to efficiently decompose halogen compounds such as $CF_4$.

Accordingly, it would be advantageous to provide an improved thermal reactor for the decomposition of highly thermally resistant contaminants in a waste gas that provides high temperatures, through the introduction of highly flammable gases, to ensure substantially complete decomposition of said waste stream while simultaneously reducing deposition of unwanted reaction products within the thermal reaction unit. Further, it would be advantageous to provide an improved thermal reaction chamber that does not succumb to the extreme temperatures and corrosive conditions needed to effectively abate the waste gas.

SUMMARY OF INVENTION

The present invention relates to methods and systems for providing controlled decomposition of gaseous liquid crystal display (LCD) and semiconductor wastes in a thermal reactor while reducing accumulation of the particulate products of said decomposition within the system. The present invention further relates to an improved thermal reactor design to reduce reactor chamber cracking during the decomposition of the gaseous waste gases.

In one aspect, the present invention relates to a thermal reactor for removing pollutant from waste gas, the thermal reactor comprising:

a) a thermal reaction unit comprising:

i) an exterior wall having a generally tubular form and a plurality of perforations for passage of a fluid therethrough, wherein the exterior wall includes at least two sections along its length, and wherein adjacent sections are interconnected by a coupling;

ii) a reticulated ceramic interior wall defining a thermal reaction chamber, wherein the interior wall has a generally tubular form and concentric with the exterior wall, wherein the interior wall comprises at least two ring sections in a stacked arrangement;

iii) at least one waste gas inlet in fluid communication with the thermal reaction chamber for introducing a waste gas therein; and iv) at least one fuel inlet in fluid communication with the thermal reaction chamber for introducing a fuel that upon combustion produces temperature that decomposes said waste gas in the thermal reaction chamber; and v) means for directing a fluid through the perforations of the exterior wall and the reticulated ceramic interior wall to reduce the deposition and accumulation of particulate matter thereon; and b) a water quench.

In yet another aspect, the present invention relates to a thermal reactor for removing pollutant from waste gas, the thermal reactor comprising:

a) a thermal reaction unit comprising:

i) an exterior wall having a generally tubular form;

ii) an interior wall having a generally tubular form and concentric with the exterior wall, wherein the interior wall defines a thermal reaction chamber;

iii) a reticulated ceramic plate positioned at or within the interior wall of the thermal reaction unit, wherein the reticulated ceramic plate seals one end of the thermal reaction chamber;

iii) at least one waste gas inlet in fluid communication with the thermal reaction chamber for introducing a waste gas therein; and iv) at least one fuel inlet in fluid communication with the thermal reaction chamber for introducing a fuel that upon combustion produces temperature that decomposes said waste gas within the thermal reaction unit; and b) a water quench.

In a further aspect, the present invention relates to a method for controlled decomposition of gaseous pollutant in a waste gas in a thermal reactor, the method comprising:

i) introducing the waste gas to a thermal reaction chamber through at least one waste gas inlet, wherein the thermal reaction chamber is defined by reticulated ceramic walls;

ii) introducing at least one combustible fuel to the thermal reaction chamber;

iii) igniting the combustible fuel in the thermal reaction chamber to effect formation of reaction products and heat evolution, wherein the heat evolved decomposes the waste gas;

iv) injecting additional fluid through the reticulated ceramic walls into the thermal reaction chamber contemporaneously with the combusting of the combustible fuel, wherein the additional fluid is injected in a continuous mode at a force exceeding that of the reaction products approaching the reticulated ceramic walls of the thermal reaction chamber thereby inhibiting deposition of the reaction products thereon; and v) flowing the stream of reaction products into a water quench to capture the reaction products therein.

Other aspects and advantages of the invention will be more fully apparent from the ensuing disclosure and appended claims

DETAILED DESCRIPTION OF PREFERRED EMBODIMENT OF THE INVENTION

The present invention relates to methods and systems for providing controlled decomposition of effluent gases in a thermal reactor while reducing accumulation of deposition products within the system. The present invention further relates to an improved thermal reactor design to reduce thermal reaction unit cracking during the high temperature decomposition of effluent gases.

Waste gas to be abated may include species generated by a semiconductor process and/or species that were delivered to and egressed from the semiconductor process without chemical alteration. As used herein, the term "semiconductor process" is intended to be broadly construed to include any and all processing and unit operations in the manufacture of semiconductor products and/or LCD products, as well as all operations involving treatment or processing of materials used in or produced by a semiconductor and/or LCD manufacturing facility, as well as all operations carried out in connection with the semiconductor and/or LCD manufacturing facility not involving active manufacturing (examples include conditioning of process equipment, purging of chemical delivery lines in preparation of operation, etch cleaning of process tool chambers, abatement of toxic or hazardous gases from effluents produced by the semiconductor and/or LCD manufacturing facility, etc.).

Figure 1:
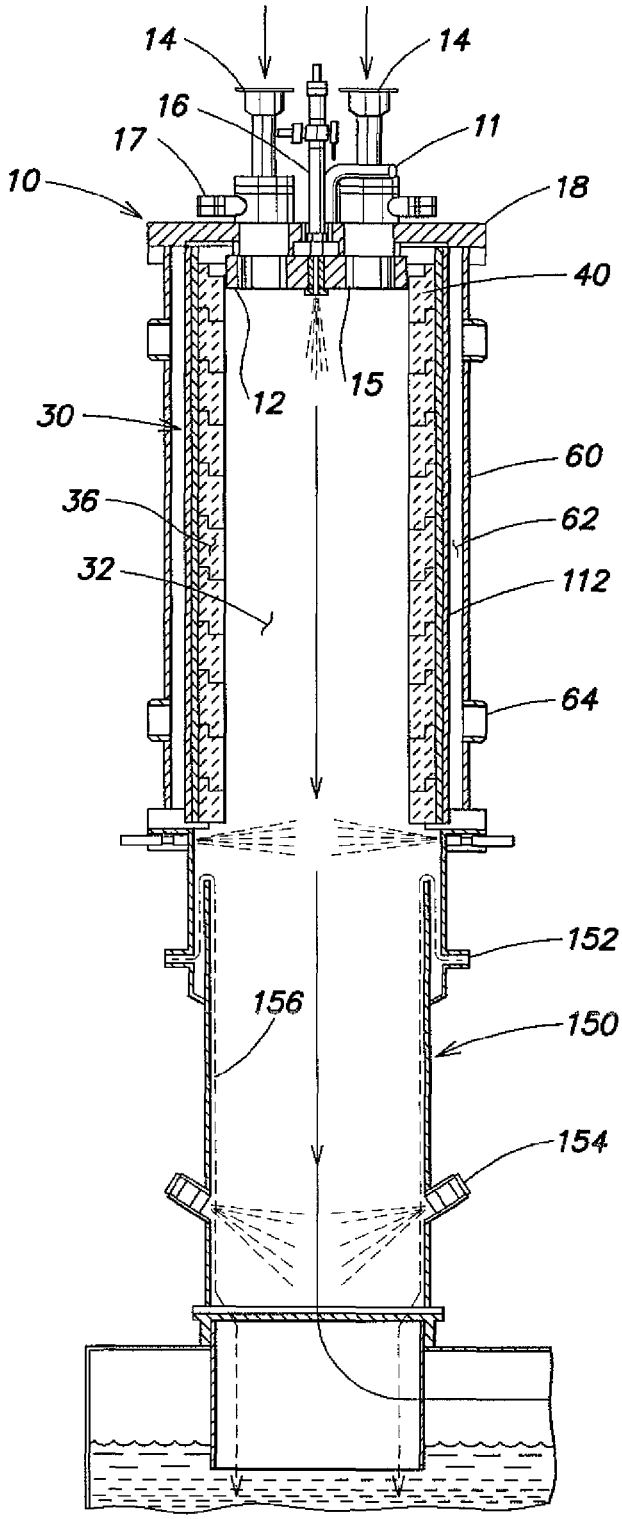
FIG. 1 is a cut away view of the thermal reaction unit, the inlet adaptor and the lower quenching chamber according to the invention

The improved thermal reaction system disclosed herein has a thermal reaction unit 30 and a lower quenching chamber 150 as shown in FIG. 1. The thermal reaction unit 30 includes a thermal reaction chamber 32, and an inlet adaptor 10 including a top plate 18, at least one waste gas inlet 14, at least one fuel inlet 17, optionally at least one oxidant inlet 11, burner jets 15, a center jet 16 and an interior plate 12 which is positioned at or within the thermal reaction chamber 32 (see also FIG. 3 for a schematic of the inlet adaptor independent of the thermal reaction unit). The inlet adaptor includes the fuel and oxidant gas inlets to provide a fuel rich gas mixture to the system for the destruction of contaminants. When oxidant is used, the fuel and oxidant may be pre-mixed prior to introduction into the thermal reaction chamber. Fuels contemplated herein include, but are not limited to, hydrogen, methane, natural gas, propane, LPG and city gas, preferably natural gas. Oxidants contemplated herein include, but are limited to, oxygen, ozone, air, clean dry air (CDA) and oxygen-enriched air. Waste gases to be abated comprise a species selected from the group consisting of $CF_4$, $C_2F_6$, $SF_6$, $C_3F_8$, $C_4H_8$, $C_4H_8O$, $SiF_4$, $BF_3$, $NF_3$, $BH_3$, $B_2H_6$, $B_5H_9$, $NH_3$, $PH_3$, $SiH_4$, $SeH_2$, $F_2$, $Cl_2$, HCl, HF, HBr, $WF_6$, $H_2$, $Al(CH_3)_3$, primary and secondary amines, organosilanes, organometallics, and halosilanes.

In one embodiment of the invention, the interior walls of the waste gas inlet 14 may be altered to reduce the affinity of particles for the interior walls of the inlet. For example, a surface may be electropolished to reduce the mechanical roughness (Ra) to a value less than 30, more preferably less than 17, most preferably less than 4. Reducing the mechanical roughness reduces the amount of particulate matter that adheres to the surface as well as improving the corrosion resistance of the surface. In the alternative, the interior wall of the inlet may be coated with a fluoropolymer coating, for example Teflon® or Halar®, which will also act to reduce the amount of particulate matter adhered at the interior wall as well as allow for easy cleaning. Pure Teflon® or pure Halar® layers are preferred, however, these materials are easily scratched or abraded. As such, in practice, the fluoropolymer coating is applied as follows. First the surface to be coated is cleaned with a solvent to remove oils, etc. Then, the surface is bead-blasted to provide texture thereto. Following texturization, a pure layer of fluoropolymer, e.g., Teflon®, a layer of ceramic filled fluoropolymer, and another pure layer of fluoropolymer are deposited on the surface in that order. The resultant fluoropolymer-containing layer is essentially scratch-resistant.

In another embodiment of the invention, the waste gas inlet 14 tube is subjected to thermophoresis, wherein the interior wall of the inlet is heated thereby reducing particle adhesion thereto. Thermophoresis may be effected by actually heating the surface of the interior wall with an on-line heater or alternatively, a hot nitrogen gas injection may be used, whereby 50-100 L per minute of hot nitrogen gas flows through the inlet. The additional advantage of the latter is the nitrogen gas flow minimizes the amount of time waste gases reside in the inlet thereby minimizing the possibility of nucleation therein.

Figure 2:
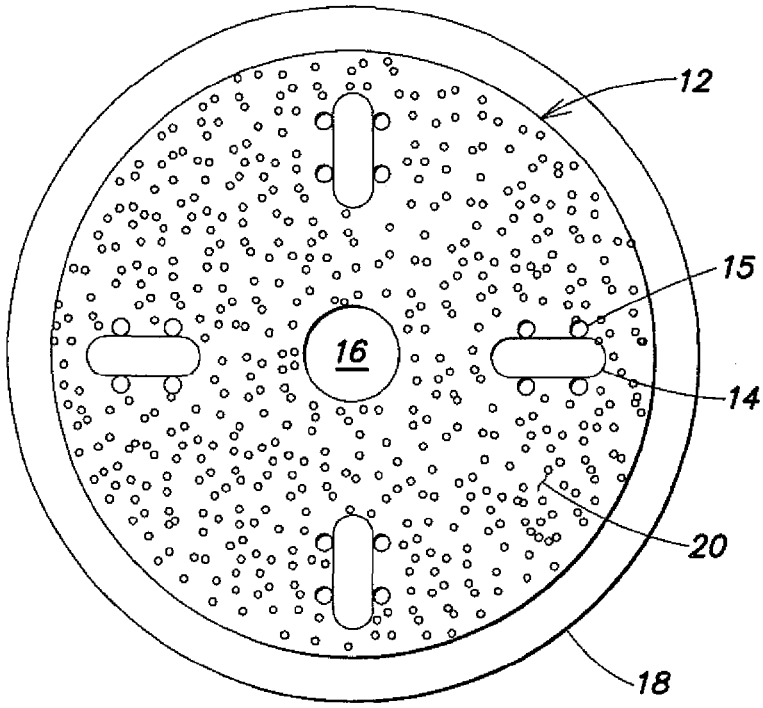
FIG. 2 is an elevational view of the interior plate of the inlet adaptor according to the invention.

Prior art inlet adaptors have included limited porosity ceramic plates as the interior plate of the inlet adaptor. A disadvantage of these limited porosity interior plates includes the accumulation of particles on said surface, eventually leading to inlet port clogging and flame detection error. The present invention overcomes these disadvantages by using a reticulated ceramic foam as the interior plate 12. FIG. 2 represents an elevational view of the interior plate 12, including the inlet ports 14, burner jets 15, a center jet port 16 (to be discussed hereinafter) and the reticulated ceramic foam 20 of the interior plate. Importantly, the reticulated ceramic foam 20 has a plurality of pores disposed therethrough. As such, the invention contemplates the passage of fluids through the pores of the interior plate to the thermal reaction chamber 32 to reduce the deposition of particulate matter at the surface of the interior plate 12 and the walls of the thermal reaction unit 30 proximate to the interior plate 12. The fluid may include any gas that is preferably pressurized to a suitable pressure, which upon diffusion through the material is sufficient to reduce deposition on the interior plate while not detrimentally affecting the abatement treatment in the thermal reaction chamber. Gases contemplated herein for passage through the pores of the interior plate 12 include air, CDA, oxygen-enriched air, oxygen, ozone and inert gases, e.g., Ar, $N_2$, etc., and should be devoid of fuels. Further, the fluid may be introduced in a continuous or a pulsating mode, preferably a continuous mode.

Although not wishing to be bound by theory, the reticulated ceramic foam interior plate helps prevent particle buildup on the interior plate in part because the exposed planar surface area is reduced thereby reducing the amount of surface available for build-up, because the reticulation of the interior plate provides smaller attachment points for growing particulate matter which will depart the interior plate upon attainment of a critical mass and because the air passing through the pores of the interior plate forms a "boundary layer," keeping particles from migrating to the surface for deposition thereon.

Ceramic foam bodies have an open cell structure characterized by a plurality of interconnected voids surrounded by a web of ceramic structure. They exhibit excellent physical properties such as high strength, low thermal mass, high thermal shock resistance, and high resistance to corrosion at elevated temperatures. Preferably, the voids are uniformly distributed throughout the material and the voids are of a size that permits fluids to easily diffuse through the material. The ceramic foam bodies should not react appreciably with PFC's in the effluent to form highly volatile halogen species. The ceramic foam bodies may include alumina materials, magnesium oxide, refractory metal oxides such as $ZrO_2$, silicon carbide and silicon nitride, preferably higher purity alumina materials, e.g., spinel, and yttria-doped alumina materials. Most preferably, the ceramic foam bodies are ceramic bodies formed from yttria-doped alumina materials and yttria-stabilized zirconia-alumina (YZA). The preparation of ceramic foam bodies is well within the knowledge of those skilled in the art.

Figure 3:
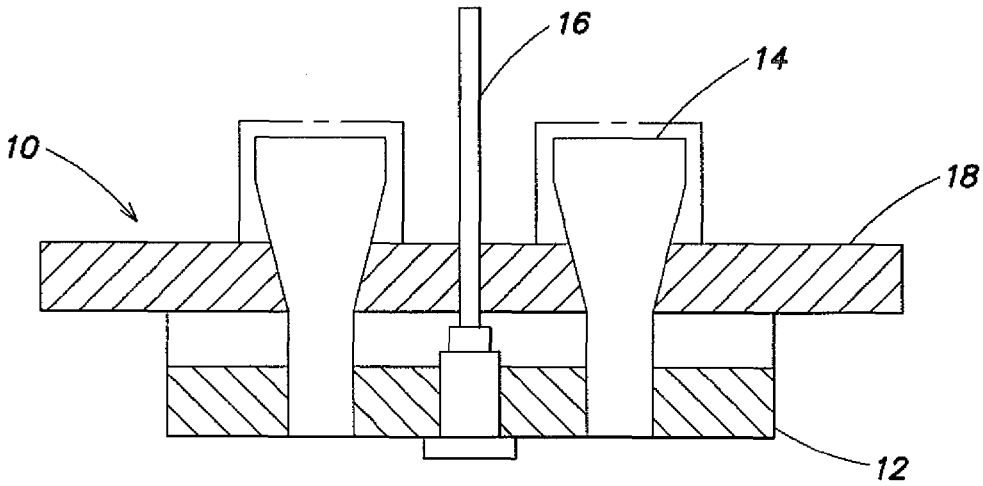
FIG. 3 is a partial cut-away view of the inlet adaptor according to the invention.
Figure 4:
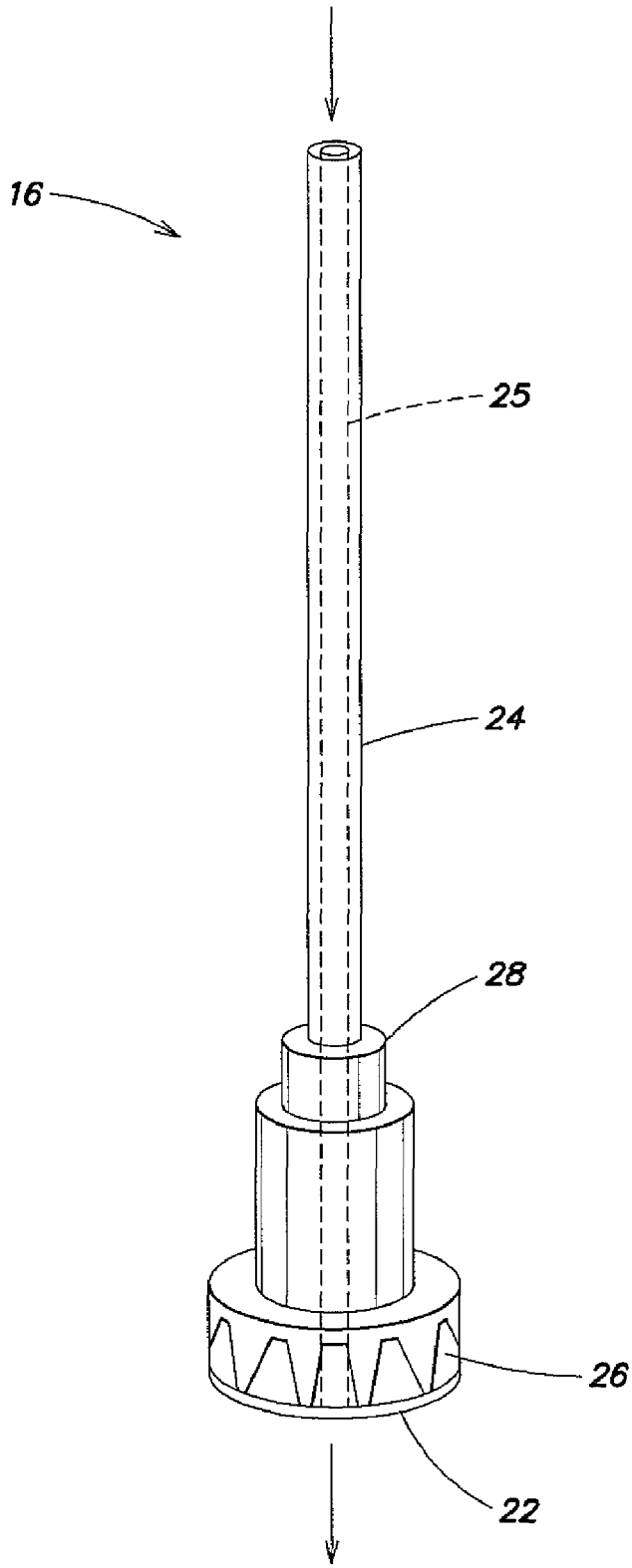
FIG. 4 is a view of a center jet according to the invention for introducing a high velocity air stream into the thermal reaction chamber.
Figure 5:
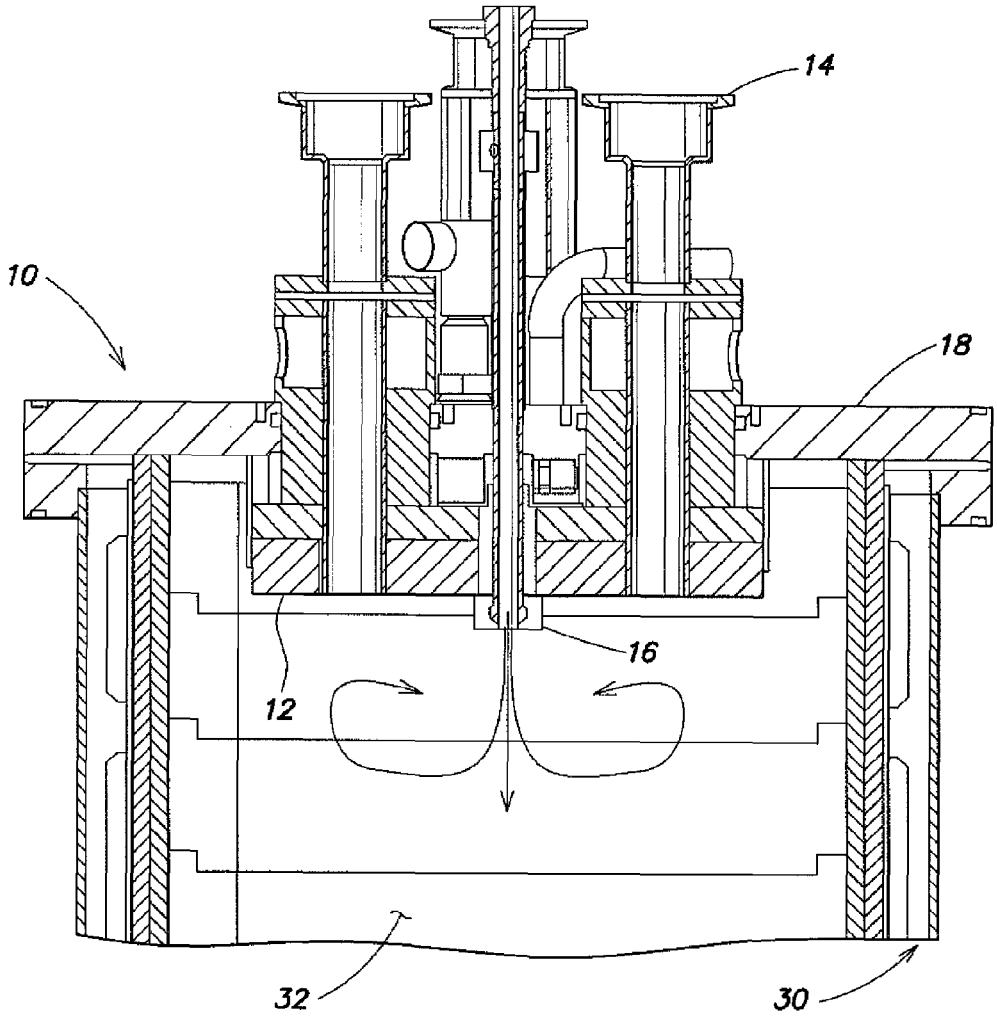
FIG. 5 is a cut away view of the inlet adaptor and the thermal reaction unit according to the invention.

To further reduce particle build-up on the interior plate 12, a fluid inlet passageway may be incorporated into the center jet 16 of the inlet adaptor 10 (see for example FIGS. 1, 3 and 5 for placement of the center jet in the inlet adaptor). An embodiment of the center jet 16 is illustrated in FIG. 4, said center jet including a pilot injection manifold tube 24, pilot ports 26, a pilot flame protective plate 22 and a fastening means 28, e.g., threading complementary to threading on the inlet adaptor, whereby the center jet and the inlet adaptor may be complementarily mated with one another in a leak-tight fashion. The pilot flame of the center jet 16 is used to ignite the burner jets 15 of the inlet adaptor. Through the center of the center jet 16 is a bore-hole 25 through which a stream of high velocity fluid may be introduced to inject into the thermal reaction chamber 32 (see, e.g., FIG. 5). Although not wishing to be bound by theory, it is thought that the high velocity air alters the aerodynamics and pulls gaseous and/or particulate components of the thermal reaction chamber towards the center of the chamber thereby keeping the particulate matter from getting close to the top plate and the chamber walls proximate to the top plate. The high velocity fluid may include any gas sufficient to reduce deposition on the interior walls of the thermal reaction unit while not detrimentally affecting the abatement treatment in the thermal reaction chamber. Further, the fluid may be introduced in a continuous or a pulsating mode, preferably a continuous mode. Gases contemplated herein include air, CDA, oxygen-enriched air, oxygen, ozone and inert gases, e.g., Ar, $N_2$, etc. Preferably, the gas is CDA and may be oxygen-enriched. In another embodiment, the high velocity fluid is heated prior to introduction into the thermal reaction chamber.

Figure 6A:
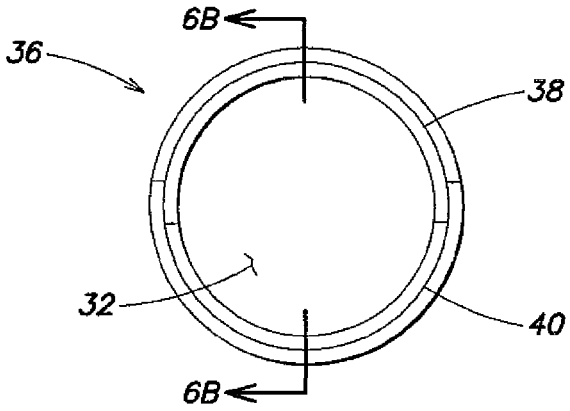
FIG. 6A is an elevational view of a ceramic ring of the thermal reaction unit according to the invention.
Figure 6B:
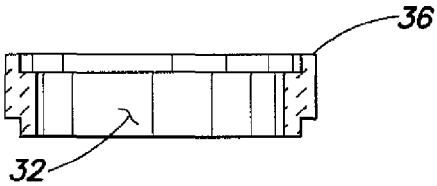
FIG. 6B is a partial cut-away view of the ceramic ring.
Figure 6C:
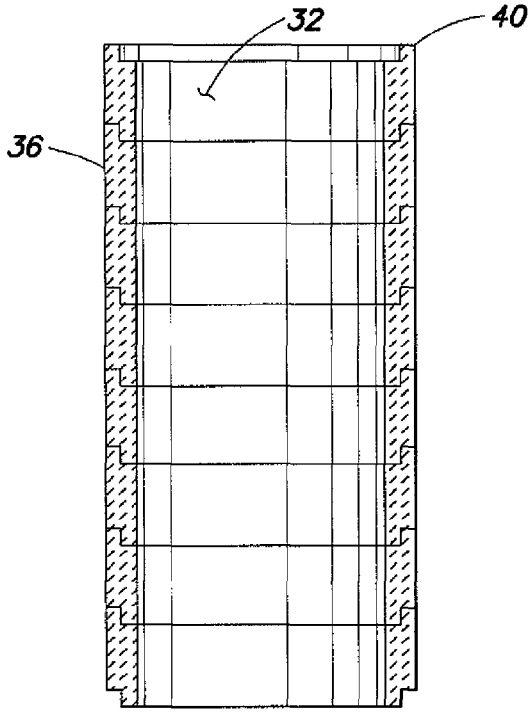
FIG. 6C is a partial cut-away view of ceramic rings stacked upon one another to define the thermal reaction chamber of the present invention.

In yet another embodiment, the thermal reaction unit includes a porous ceramic cylinder design defining the thermal reaction chamber 32. High velocity air may be directed through the pores of the thermal reaction unit 30 to at least partially reduce particle buildup on the interior walls of the thermal reaction unit. The ceramic cylinder of the present invention includes at least two ceramic rings stacked upon one another, for example as illustrated in FIG. 6C. More preferably, the ceramic cylinder includes at least about two to about twenty rings stacked upon one another. It is understood that the term "ring" is not limited to circular rings per se, but may also include rings of any polygonal or elliptical shape. Preferably, the rings are generally tubular in form.

FIG. 6C is a partial cut-away view of the ceramic cylinder design of the present invention showing the stacking of the individual ceramic rings 36 having a complimentary ship-lap joint design, wherein the stacked ceramic rings define the thermal reaction chamber 32. The uppermost ceramic ring 40 is designed to accommodate the inlet adaptor. It is noted that the joint design is not limited to lap joints but may also include beveled joints, butt joints, lap joints and tongue and groove joints. Gasketing or sealing means, e.g., GRAFOIL® or other high temperature materials, positioned between the stacked rings is contemplated herein, especially if the stacked ceramic rings are butt jointed. Preferably, the joints between the stacked ceramic rings overlap, e.g., ship-lap, to prevent infrared radiation from escaping from the thermal reaction chamber.

Each ceramic ring may be a circumferentially continuous ceramic ring or alternatively, may be at least two sections that may be joined together to make up the ceramic ring. FIG. 6A illustrates the latter embodiment, wherein the ceramic ring 36 includes a first arcuate section 38 and a second arcuate section 40, and when the first and second arcuate sections are coupled together, a ring is formed that defines a portion of the thermal reaction chamber 32. The ceramic rings are preferably formed of the same materials as the ceramic foam bodies discussed previously, e.g., YZA.

The advantage of having a thermal reaction chamber defined by individual stacked ceramic rings includes the reduction of cracking of the ceramic rings of the chamber due to thermal shock and concomitantly a reduction of equipment costs. For example, if one ceramic ring cracks, the damaged ring may be readily replaced for a fraction of the cost and the thermal reactor placed back online immediately.

Figure 7:
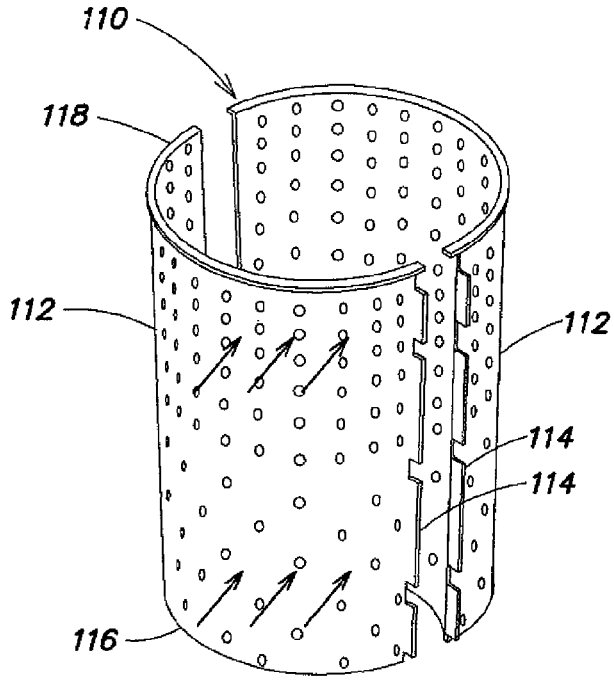
FIG. 7 is a view of the sections of the perforated metal shell according to the invention.

The ceramic rings of the invention must be held to another to form the thermal reaction unit 30 whereby high velocity air may be directed through the pores of the ceramic rings of the thermal reaction unit to at least partially reduce particle buildup at the interior walls of the thermal reaction unit. Towards that end, a perforated metal shell may be used to encase the stacked ceramic rings of the thermal reaction unit as well as control the flow of axially directed air through the porous interior walls of the thermal reaction unit. FIG. 7 illustrates an embodiment of the perforated metal shell 110 of the present invention, wherein the metal shell has the same general form of the stacked ceramic rings, e.g., a circular cylinder or a polygonal cylinder, and the metal shell includes at least two attachable sections 112 that may be joined together to make up the general form of the ceramic cylinder. The two attachable sections 112 include ribs 114, e.g., clampable extensions 114, which upon coupling put pressure on the ceramic rings thereby holding the rings to one another.

Figure 8:
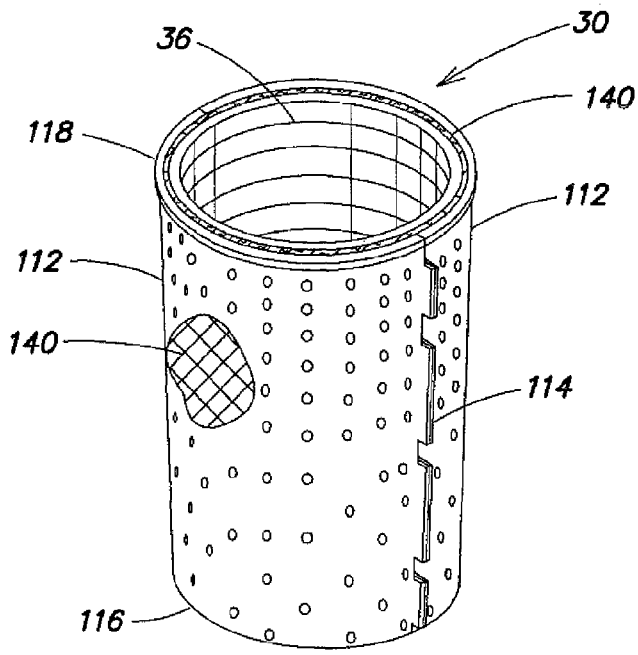
FIG. 8 is an exterior view of the thermal reaction unit according to the invention.

The metal shell 110 has a perforated pattern whereby preferably more air is directed towards the top of the thermal reaction unit, e.g., the portion closer to the inlet adaptor 10, than the bottom of the thermal reaction unit, e.g., the lower chamber (see FIGS. 7 and 8). In the alternative, the perforated pattern is the same throughout the metal shell. As defined herein, "perforations" may represent any array of openings through the metal shell that do not compromise the integrity and strength of the metal shell, while ensuring that the flow of axially directed air through the porous interior walls may be controlled. For example, the perforations may be holes having circular, polygonal or elliptical shapes or in the alternative, the perforations may be slits of various lengths and widths. In one embodiment, the perforations are holes 1/16" in diameter, and the perforation pattern towards the top of the thermal reaction unit has 1 hole per square inch, while the perforation pattern towards the bottom of the thermal reaction unit has 0.5 holes per square inch (in other words 2 holes per 4 square inches). Preferably, the perforation area is about 0.1% to 1% of the area of the metal shell. The metal shell is constructed from corrosion-resistant metals including, but not limited to: stainless steel; austenitic nickel-chromium-iron alloys such as Inconel® 600, 601, 617, 625, 625 LCF, 706, 718, 718 SPF, X-750, MA754, 783, 792, and HX; and other nickel-based alloys such as Hastelloy B, B2, C, C22, C276, C2000, G, G2, G3 and G30.

Referring to FIG. 8, the thermal reaction unit of the invention is illustrated. The ceramic rings 36 are stacked upon one another, at least one layer of a fibrous blanket 140 is wrapped around the exterior of the stacked ceramic rings and then the sections 112 of the metal shell 110 are positioned around the fibrous blanket 140 and tightly attached together by coupling the ribs 114. The fibrous blanket 140 can be any fibrous inorganic material having a low thermal conductivity, high temperature capability and an ability to deal with the thermal expansion coefficient mismatch of the metal shell and the ceramic rings. Fibrous blanket material contemplated herein includes, but is not limited to, spinel fibers, glass wool and other materials comprising aluminum silicates. In the alternative, the fibrous blanket 140 may be a soft ceramic sleeve.

In practice, fluid flow is axially and controllably introduced through the perforations of the metal shell, the fibrous blanket 140 and the reticulated ceramic rings of the cylinder. The fluid experiences a pressure drop from the exterior of the thermal reaction unit to the interior of the thermal reaction unit in a range from about 0.05 psi to about 0.30 psi, preferably about 0.1 psi to 0.2 psi. The fluid may be introduced in a continuous or a pulsating mode, preferably a continuous mode to reduce the recirculation of the fluid within the thermal reaction chamber. It should be appreciated that an increased residence time within the thermal reaction chamber, wherein the gases are recirculated, results in the formation of larger particulate material and an increased probability of deposition within the reactor. The fluid may include any gas sufficient to reduce deposition on the interior walls of the ceramic rings while not detrimentally affecting the abatement treatment in the thermal reaction chamber. Gases contemplated include air, CDA, oxygen-enriched air, oxygen, ozone and inert gases, e.g., Ar, $N_2$, etc.

To introduce fluid to the walls of the thermal reaction unit for passage through to the thermal reaction chamber 32, the entire thermal reaction unit 30 is encased within an outer stainless steel reactor shell 60 (see, e.g., FIG. 1), whereby an annular space 62 is created between the interior wall of the outer reactor shell 60 and the exterior wall of the thermal reaction unit 30. Fluids to be introduced through the walls of the thermal reaction unit may be introduced at ports 64 positioned on the outer reactor shell 60.

Figure 9:
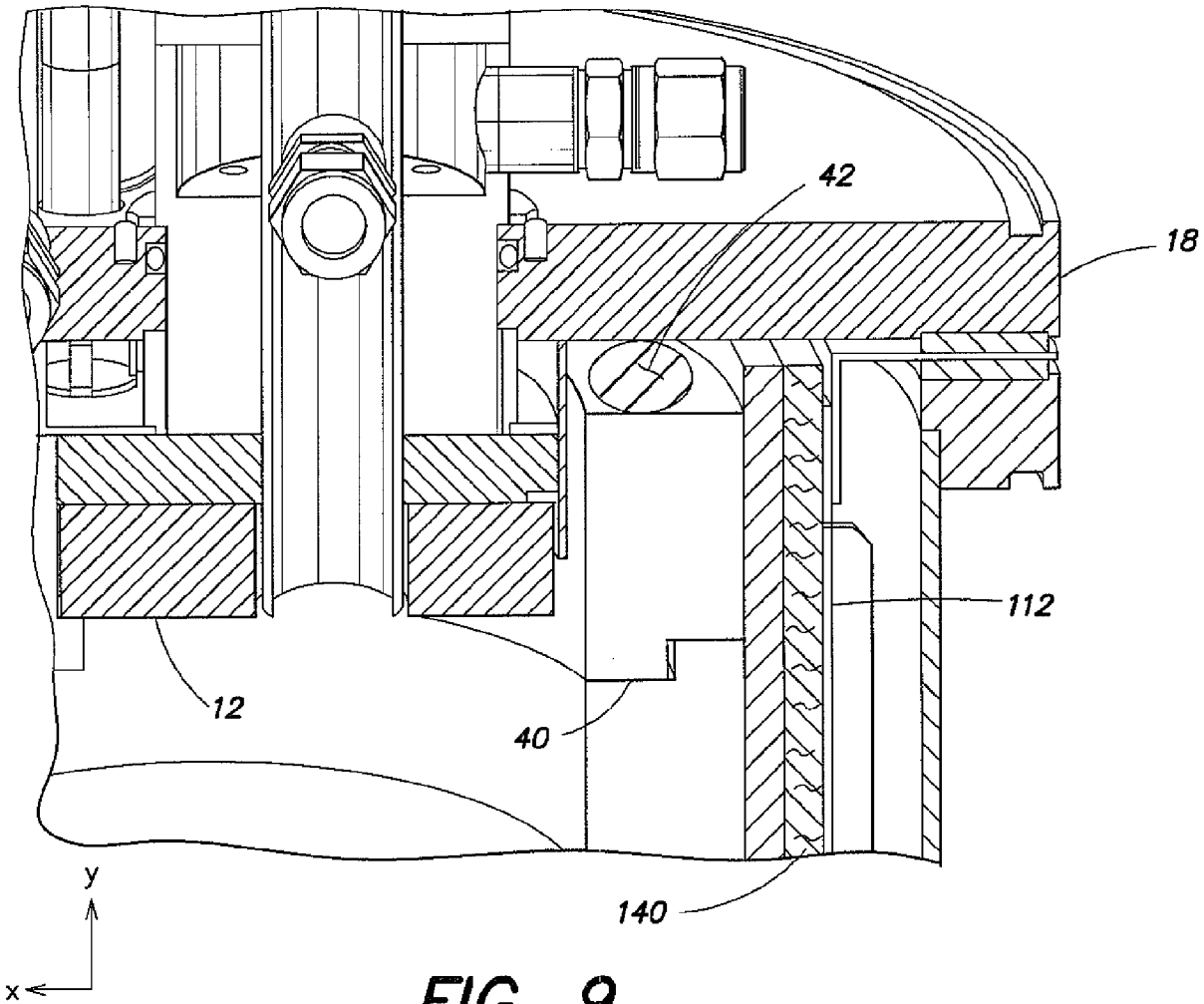
FIG. 9 is a partial cut-away view of the inlet adaptor/thermal reaction unit joint according to the invention.

Referring to FIG. 1, the interior plate 12 of the inlet adaptor 10 is positioned at or within the thermal reaction chamber 32 of the thermal reaction unit 30. To ensure that gases within the thermal reaction unit do not leak from the region where the inlet adaptor contacts the thermal reaction unit, a gasket or seal 42 is preferably positioned between the top ceramic ring 40 and the top plate 18 (see, e.g., FIG. 9). The gasket or seal 42 may be GRAFOIL® or some other high temperature material that will prevent leakage of blow-off air through the top plate/thermal reaction unit joint, i.e., to maintain a backpressure behind the ceramic rings for gas distribution.

Figure 10A:
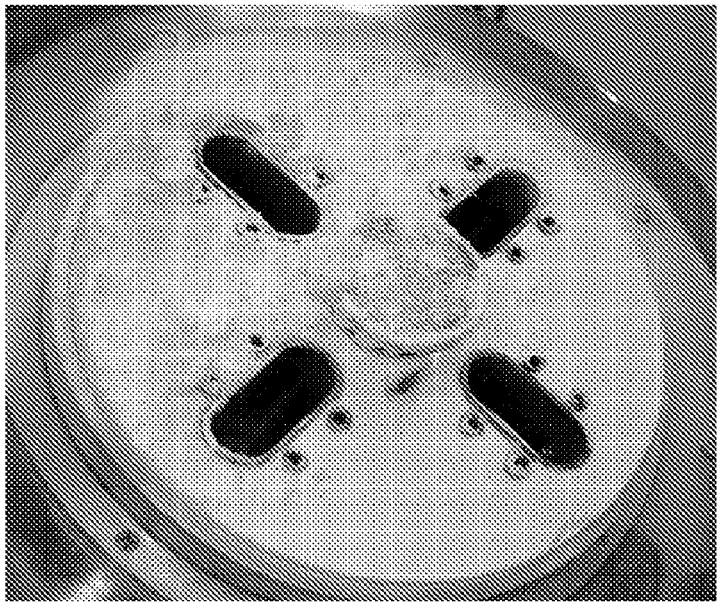
FIG. 10A (Prior Art)
FIG. 10A is a photograph of the deposition of residue on the interior plate of the inlet adaptor of the prior art.
Figure 10B:
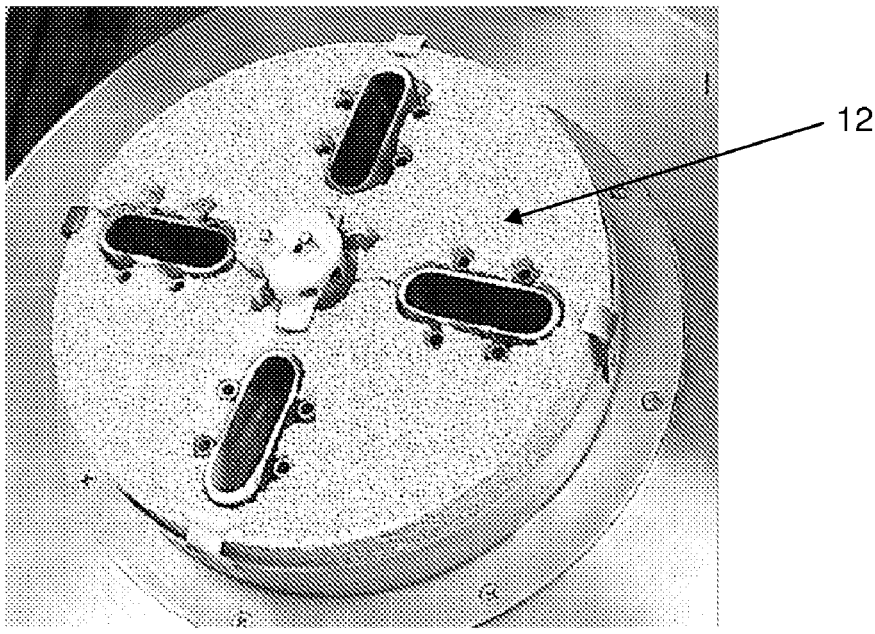
FIG. 10B is a photograph of the deposition of residue on the interior plate of the inlet adaptor according to the invention.

FIGS. 10A and 10B show the buildup of particulate matter on a prior art interior plate and an interior plate according to the present invention, respectively. It can be seen that the buildup on the interior plate of the present invention (having a reticulated foam plate with fluid emanating from the pores, a reticulated ceramic cylinder with fluid emanating from the pores and high velocity fluid egression from the center jet) is substantially reduced relative to the interior plate of the prior art, which is devoid of the novel improvements disclosed herein.

Figure 11A:
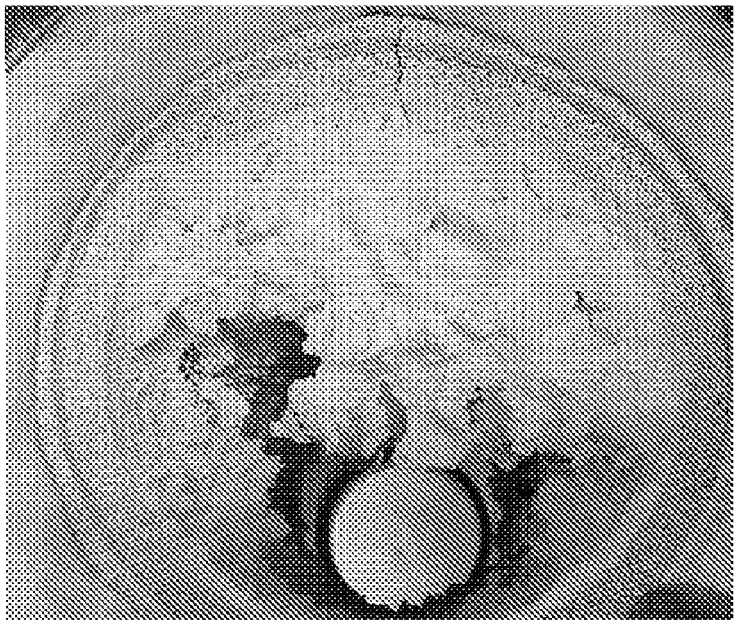
FIG. 11A (Prior Art)
FIG. 11A is a photograph of the deposition of residue on the interior walls of the thermal reaction unit of the prior art.
Figure 11B:
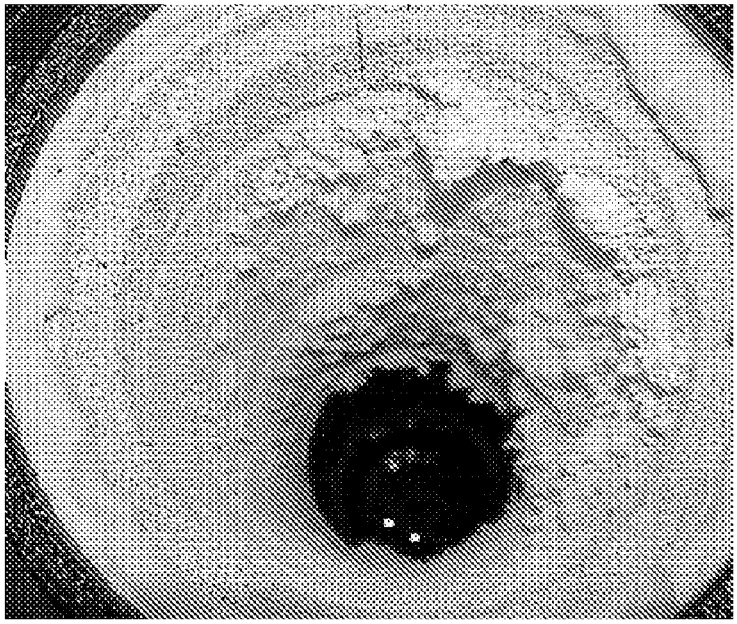
FIG. 11B is a photograph of the deposition of residue on the interior walls of the thermal reaction unit according to the invention.

FIGS. 11A and 11B represent photographs of prior art thermal reaction units and the thermal reaction unit according to the present invention, respectively. It can be seen that the buildup of particulate matter on the interior walls of the thermal reaction unit of the present invention is substantially reduced relative to prior art thermal reaction unit walls. Using the apparatus and method described herein, the amount of particulate buildup at the interior walls of the thermal reaction unit is reduced by at least 50%, preferably at least 70% and more preferably at least 80%, relative to prior art units oxidizing an equivalent amount of effluent gas.

Downstream of the thermal reaction chamber is a water quenching means positioned in the lower quenching chamber 150 to capture the particulate matter that egresses from the thermal reaction chamber. The water quenching means may include a water curtain as disclosed in co-pending U.S. patent application Ser. No. 10/249,703 in the name of Glenn Tom et al., entitled "Gas Processing System Comprising a Water Curtain for Preventing Solids Deposition on Interior Walls Thereof," which is hereby incorporated by reference in the entirety. Referring to FIG. 1, the water for the water curtain is introduced at inlet 152 and water curtain 156 is formed, whereby the water curtain absorbs the heat of the combustion and decomposition reactions occurring in the thermal reaction unit 30, eliminates build-up of particulate matter on the walls of the lower quenching chamber 150, and absorbs water soluble gaseous products of the decomposition and combustion reactions, e.g., $CO_2$, HF, etc.

To ensure that the bottom-most ceramic ring does not get wet, a shield 202 (see, e.g., FIG. 12) may be positioned between the bottom-most ceramic ring 198 and the water curtain in the lower chamber 150. Preferably, the shield is L-shaped and assumes the three-dimensional form of the bottom-most ceramic ring, e.g., a circular ring, so that water does not come in contact with the bottom-most ceramic ring. The shield may be constructed from any material that is water- and corrosion-resistant and thermally stable including, but not limited to: stainless steel; austenitic nickel-chromium-iron alloys such as Inconel® 600, 601, 617, 625, 625 LCF, 706, 718, 718 SPF, X-750, MA754, 783, 792, and HX; and other nickel-based alloys such as Hastelloy B, B2, C, C22, C276, C2000, G, G2, G3 and G30.

In practice, effluent gases enter the thermal reaction chamber 32 from at least one inlet provided in the inlet adaptor 10, and the fuel/oxidant mixture enter the thermal reaction chamber 32 from at least one burner jet 15. The pilot flame of the center jet 16 is used to ignite the burner jets 15 of the inlet adaptor, creating thermal reaction unit temperatures in a range from about 500° C. to about 2000° C. The high temperatures facilitate decomposition of the effluent gases that are present within the thermal reaction chamber. It is also possible that some effluent gases undergo combustion/oxidation in the presence of the fuel/oxidant mixture. The pressure within the thermal reaction chamber is in a range from about 0.5 atm to about 5 atm, preferably slightly subatmospheric, e.g., about 0.98 atm to about 0.99 atm.

Following decomposition/combustion, the effluent gases pass to the lower chamber 150 wherein a water curtain 156 may be used to cool the walls of the lower chamber and inhibit deposition of particulate matter on the walls. It is contemplated that some particulate matter and water soluble gases may be removed from the gas stream using the water curtain 156. Further downstream of the water curtain, a water spraying means 154 may be positioned within the lower quenching chamber 150 to cool the gas stream, and remove the particulate matter and water soluble gases. Cooling the gas stream allows for the use of lower temperature materials downstream of the water spraying means thereby reducing material costs. Gases passing through the lower quenching chamber may be released to the atmosphere or alternatively may be directed to additional treatment units including, but not limited to, liquid/liquid scrubbing, physical and/or chemical adsorption, coal traps, electrostatic precipitators, and cyclones. Following passage through the thermal reaction unit and the lower quenching chamber, the concentration of the effluent gases is preferably below detection limits, e.g., less than 1 ppm. Specifically, the apparatus and method described herein removes greater than 90% of the toxic effluent components that enter the abatement apparatus, preferably greater than 98%, most preferably greater than 99.9%.

Figure 12:
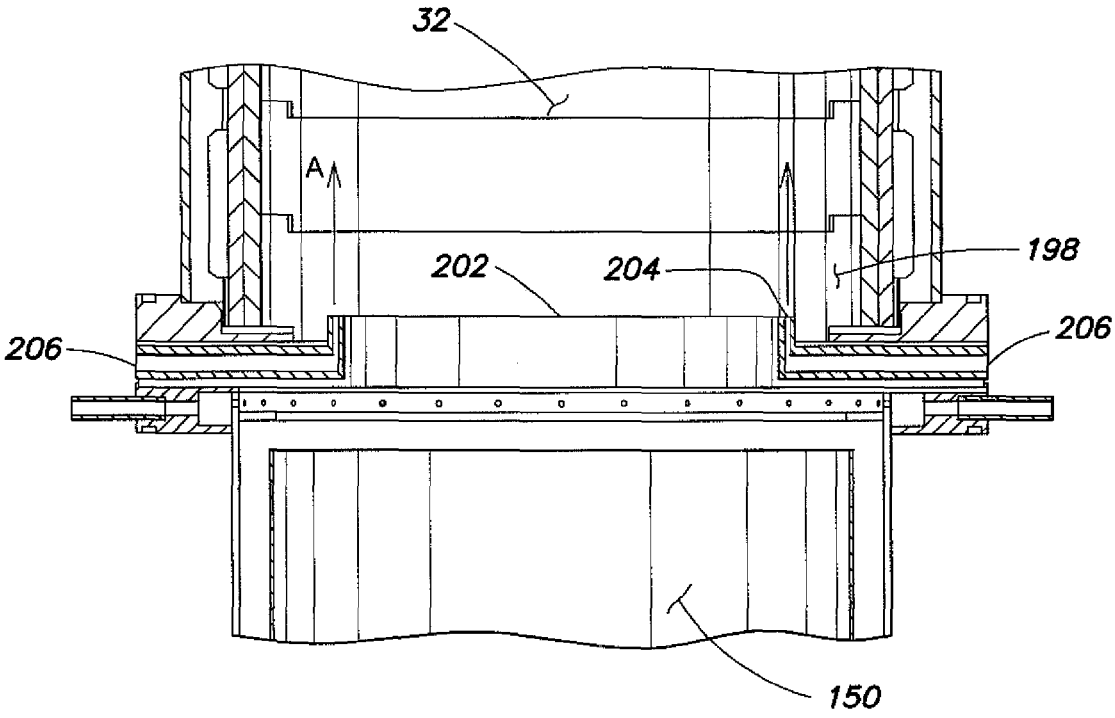
FIG. 12 is a partial cut-away view of the shield positioned between the thermal reaction unit and the lower quenching chamber according to the invention.

In an alternative embodiment, an "air knife" is positioned within the thermal reaction unit. Referring to FIG. 12, fluid may be intermittently injected into the air knife inlet 206, which is situated between the bottom-most ceramic ring 198 and the water quenching means in the lower quenching chamber 150. The air knife inlet 206 may be incorporated into the shield 202 which prevents water from wetting the bottom-most ceramic ring 198 as described hereinabove. The air knife fluid may include any gas sufficient to reduce deposition on the interior walls of the thermal reaction unit while not detrimentally affecting the decomposition treatment in said unit. Gases contemplated include air, CDA, oxygen-enriched air, oxygen, ozone and inert gases, e.g., Ar, $N_2$, etc. In operation, gas is intermittently injected through the air knife inlet 206 and exits a very thin slit 204 that is positioned parallel to the interior wall of the thermal reaction chamber 32. Thus, gases are directed upwards along the wall (in the direction of the arrows in FIG. 12) to force any deposited particulate matter from the surface of the interior wall.

Example

To demonstrate the abatement effectiveness of the improved thermal reactor described herein, a series of experiments were performed to quantify the efficiency of abatement using said thermal reactor. It can be seen that greater than 99% of the test gases were abated using the improved thermal reactor, as shown in Table 1.

TABLE 1

Results of abatement experiments using the embodiments described herein.

| Test gas | Flow rate/slm | Fuel/slm | DRE, % |
|---|---|---|---|
| $C_2F_6$ | 2.00 | 50 | >99.9% |
| $C_3F_8$ | 2.00 | 45 | >99.9% |
| $NF_3$ | 2.00 | 33 | >99.9% |
| $SF_6$ | 5.00 | 40 | 99.6% |
| $CF_4$ | 0.25 | 86 | 99.5% |
| $CF_4$ | 0.25 | 83 | 99.5% |

Although the invention has been variously described herein with reference to illustrative embodiments and features, it will be appreciated that the embodiments and features described hereinabove are not intended to limit the invention, and that other variations, modifications and other embodiments will readily suggest themselves to those of ordinary skill in the art, based on the disclosure herein. The invention therefore is to be broadly construed, consistent with the claims hereafter set forth.

The invention claimed is:

1. An apparatus for use during the abatement of a semiconductor manufacturing process comprising:

a thermal reaction unit having:

an interior porous wall that defines a central chamber, the interior porous wall formed from a plurality of stacked porous sections;

at least one waste gas inlet in fluid communication with the central chamber and adapted to introduce a gaseous waste stream to the central chamber;

a thermal mechanism positioned within the central chamber and adapted to decompose the gaseous waste stream within the central chamber, thereby forming reaction products;

a fluid delivery system adapted to provide a fluid to the central chamber through the interior porous wall at a sufficient force to reduce deposition of reaction products on an inner surface of the interior porous wall of the central chamber;

a water quench unit coupled to the thermal reaction unit and adapted to receive a gas stream from the thermal reaction unit; and a shield configured to be positioned between the quench unit and the interior porous wall and adapted to prevent water wetting a bottommost porous section of the plurality of stacked porous sections, the shield including an air knife inlet, wherein the air knife inlet injects an air knife to remove deposited material from the interior porous wall.

2. The apparatus of claim 1, wherein the interior porous wall has a generally tubular form.

3. The apparatus of claim 1, wherein each of the stacked porous sections are arcuate in shape.

4. The apparatus of claim 1, wherein the interior porous wall comprises at least about twenty stacked porous sections.

5. The apparatus of claim 1, wherein the stacked porous sections are complimentarily jointed for connection of adjacent porous sections.

6. The apparatus of claim 5, wherein each stacked porous section is complimentarily jointed with at least one joint selected from the group consisting of ship-lap joints, beveled joints, butt joints, lap joints and tongue-and-groove joints.

7. The apparatus of claim 1, wherein each stacked porous section comprises a porous ceramic.

8. The apparatus of claim 1, wherein each stacked porous section comprises a reticulated ceramic.

9. The apparatus of claim 8 wherein each stacked porous section comprises material selected from the group consisting of alumina materials, magnesium oxide, refractory metal oxides, silicon carbide, silicon nitride, and yttria-doped alumina materials.

10. The apparatus of claim 1, wherein the thermal reaction chamber is adapted so that more fluid flows through the interior porous wall in proximity to the waste gas inlet than in proximity to an outlet of the thermal reaction unit.

11. The apparatus of claim 1 further comprising a first exterior wall that surrounds the interior porous wall, the first exterior wall having a plurality of perforations for passage of fluid through the first exterior wall to the interior porous wall.

12. The apparatus of claim 11, wherein the first exterior wall comprises corrosion-resistant and thermally stable metal.

13. The apparatus of claim 12, wherein the first exterior wall comprises a material selected from the group consisting of stainless steel, austenitic nickel-chromium-iron alloys and other nickel-based alloys.

14. The apparatus of claim 11 further comprising:

a second exterior wall that surrounds the first exterior wall and the interior porous wall and that defines an interior space between the second exterior wall and the first exterior wall;

wherein the fluid delivery system is adapted to provide a fluid to the central chamber through the interior porous wall by providing fluid to the interior space between the second exterior wall and the first exterior wall.

15. The apparatus of claim 1 further comprising:

a second reaction chamber coupled to the thermal reaction unit and having:

a gas flow chamber in fluid communication with the central chamber, the gas flow chamber having an inlet and outlet for passing the gaseous waste stream and reaction products through the gas flow chamber; and the water quench unit, wherein the water quench unit is adapted to generate a flowing liquid film on an interior surface of the gas flow chamber so as to reduce deposition and accumulation of particulate solids on the interior surface of the gas flow chamber.

16. The apparatus of claim 1 wherein the thermal mechanism further includes a bore-hole through a center jet adapted to introduce a stream of high velocity fluid into the thermal reaction unit.

17. The apparatus of claim 16 wherein the high velocity fluid pulls reaction products towards a center of the thermal reaction unit.

18. An apparatus for use during the abatement of a semiconductor manufacturing process comprising:

a upper reaction chamber having:

an interior porous wall that defines a central chamber, the interior porous wall formed from a plurality of stacked, replaceable porous sections;

a first exterior wall that surrounds and supports the stacked porous sections of the interior porous wall and that includes a plurality of perforations that allow passage of fluid through the first exterior wall to the interior porous wall;

a second exterior wall that surrounds the first exterior wall and the interior porous wall and that defines an interior space between the second exterior wall and the first exterior wall;

at least one waste gas inlet in fluid communication with the central chamber and adapted to introduce a gaseous waste stream to the central chamber;

at least one fuel inlet in fluid communication with the central chamber and adapted to introduce fuel to the central chamber;

a thermal mechanism positioned within the central chamber and adapted to decompose the gaseous waste stream within the central chamber, thereby forming reaction products; and a fluid delivery system adapted to provide a fluid to the central chamber through the interior porous wall at a sufficient force to reduce deposition of reaction products on an inner surface of the interior porous wall of the central chamber; and a lower reaction chamber coupled to the upper reaction chamber and having:

a gas flow chamber in fluid communication with the central chamber, the gas flow chamber having an inlet and outlet for passing the gaseous waste stream and reaction products through the gas flow chamber;

a water delivery system adapted to generate a flowing liquid film on an interior surface of the gas flow chamber so as to reduce deposition and accumulation of particulate solids on the interior surface of the gas flow chamber; and a shield configured to be positioned between the quench unit and the interior porous wall and adapted to prevent water wetting a bottommost porous section of the plurality of stacked porous sections, the shield including an air knife inlet, wherein the air knife inlet injects an air knife to remove deposited material from the interior porous wall.

19. The system of claim 18 further comprising an interior porous plate that encloses an inlet end of the central chamber, the interior porous plate adapted to pass a fluid through the interior porous plate to the central chamber so as to reduce deposition of particulate matter on an interior surface of the interior porous plate.

20. The system of claim 18 further comprising at least one inlet adapted to introduce fluid to a gas stream as the gas stream travels from the upper reaction chamber to the lower reaction chamber.

21. The system of claim 18 further comprising a drainage tank coupled to the lower reaction chamber having headspace adapted to receive a gaseous waste stream from the lower reaction chamber.

22. The system of claim 21 further comprising at least one scrubbing unit adapted to receive the gaseous waste stream from the headspace of the drainage tank.

23. A replacement part for use in an abatement system comprising:

a shield including an air knife inlet, the shield configured to:

be positioned between a quench unit and a porous wall that defines a central chamber of a thermal reactor for use during decomposition of gaseous waste from a semiconductor manufacturing process; and prevent the porous wall of the central chamber from getting wet during operation of the quench unit, and wherein the air knife inlet injects an air knife into the central chamber to remove deposited material from the interior porous wall.

24. The replacement part of claim 23 wherein shield is L-shaped.

25. The replacement part of claim 23 wherein the shield is configured to assume a three-dimensional form of a bottom portion of the porous wall.

26. The replacement part of claim 25 wherein the porous wall includes a bottom-most ceramic ring and wherein the shield is a ring that prevents water from coming into contact with the bottom-most ceramic ring.

27. The replacement part of claim 23 wherein the shield comprises a material selected from the group consisting of stainless steel, austenitic nickel-chromium-iron alloys and other nickel-based alloys.

* * * * *